US005732454A

United States Patent [19]

Busenhart et al.

[11] Patent Number: 5,732,454

[45] Date of Patent: Mar. 31, 1998

[54] METHOD AND APPARATUS FOR STUFFER BOX CRIMPING SYNTHETIC FILAMENT THREADS

[75] Inventors: Peter Busenhart, Wiesendangen; Jörg Maier; Felix Graf, both of Winterthur, all of Switzerland

[73] Assignee: Maschinenfabrik Rieter AG, Winterthur, Switzerland

[21] Appl. No.: 701,401

[22] Filed: Aug. 22, 1996

[30] Foreign Application Priority Data

Aug. 23, 1995 [CH] Switzerland ..... 02401/95
May 14, 1996 [CH] Switzerland ..... 1229/96

[51] Int. Cl.[6] ..... B25B 27/14
[52] U.S. Cl. ..... 28/271
[58] Field of Search ..... 28/271, 272, 273, 28/274, 275, 276

[56] References Cited

U.S. PATENT DOCUMENTS

| | | | |
|---|---|---|---|
| 3,341,394 | 9/1967 | Kinney . | |
| 3,525,134 | 8/1970 | Coon | 28/1.4 |
| 3,655,862 | 4/1972 | Dorschner et al. . | |
| 4,124,924 | 11/1978 | Phillips et al. | 28/271 |
| 4,535,516 | 8/1985 | Egbers et al. | 17/272 |
| 4,724,588 | 2/1988 | Runkel | 28/272 |
| 4,829,640 | 5/1989 | Greb et al. | 28/272 |
| 5,579,566 | 12/1996 | Burkhardt et al. | 28/272 |

FOREIGN PATENT DOCUMENTS

| | | |
|---|---|---|
| 2 253 856 | 7/1975 | France . |
| 1785158 | 3/1971 | Germany . |
| 2753705 | 6/1979 | Germany . |

OTHER PUBLICATIONS

International Search Report dated 21 Mar. 1996.

*Primary Examiner*—C. D. Crowder
*Assistant Examiner*—Larry D. Worrell, Jr.
*Attorney, Agent, or Firm*—Burns, Doane, Swecker & Mathis, L.L.P.

[57] ABSTRACT

An apparatus for stuffer box crimping a synthetic filament thread includes a thread inlet duct for aspiring and guiding synthetic filament threads to a stuffer box. The apparatus includes a flow duct, the thread inlet duct preceding the flow duct, the flow duct and the thread inlet duct having a common longitudinal axis. The apparatus is provided with a nozzle having an outlet opening merging into the flow duct, for supplying a fluid under pressure. The two or more sets of nozzles may be arranged consecutively along the longitudinal axis of the thread inlet duct and the flow duct in a direction of thread transport.

17 Claims, 5 Drawing Sheets

METHOD AND APPARATUS FOR STUFFER BOX CRIMPING SYNTHETIC FILAMENT THREADS

FIELD OF THE INVENTION

The present invention concerns a method and apparatus for stuffer box crimping synthetic filament threads.

BACKGROUND AND SUMMARY

The preliminary step of stuffer box crimping concerns the aspiration of the filament threads under application of a sufficiently high tension to the filament threads upstream of the thread aspiring suction nozzle in order to prevent lapping problems that could arise on the preceding godets. However, processing speed of filament threads, i.e., the aspiring suction speed into the texturing nozzle, has increased considerably owing to improved and faster texturing methods, which creates more severe demands on the aspiring suction nozzle arranged upstream from the stuffer box. Thread processing speeds, e.g., at the inlet of the texturing nozzle, i.e., at the inlet of the aspiring suction nozzle, of 4000 m/min are known which presents very severe demands on a pneumatic take-off device.

From the European Patent Nr. 0 189 099B1 a nozzle for texturing a thread is known in which the flow duct, through which the filament threads together with the pressure fluid effluent are guided, and the propellant fluid ducts are designed with round and, in particular, with circular cross-sections the diameter of which are constant over their lengths. This device was applicable for processing speeds of up to 3000 m/min.

According to European Patent Nr. 0 539 808B1, the aforementioned nozzle, at processing speeds exceeding 3000 m/min, generates insufficient thread tension which evokes the danger of lap formation on the draw godets and thus renders the production method insecure.

EP 0 539 808 sets as a goal eliminating this disadvantage and proposes an apparatus for stuffer box crimping synthetic filament threads in which the filament threads are taken in via a thread inlet duct and the pressure fluid is fed via at least one blow duct, preferably a ring-shaped slot arranged on the curved surface of a straight circular cone in which arrangement the filament threads together with the pressure fluid are carried through a smallest portion of a narrowing flow duct in which sonic speed is attained and subsequently in a widening portion of the flow duct in which supersonic speed is attained.

In this method, an air current flowing against the direction of thread transport develops due to the pressure prevailing in the narrowing flow duct, which can result in a braking effect acting onto the thread to be transported.

This effect mentioned in DE-27 53 705 is desirable here but to a very slight degree. In the arrangement disclosed in that document according to the state of the art the blow nozzle is formed as a Laval nozzle but with a thread guide tube inserted concentrically in the Laval nozzle. The outer surface of the thread guide tube, together with the inside wall of the nozzle, guides the air flow. At sufficiently high pressures, e.g., between 5 and 40 bar, preferably between 6 and 35 bar, at the narrowest portion of the Laval nozzle sonic speed is obtained and in the widening portion of the nozzle supersonic speed is obtained. The circular nozzle outlet end rim of the thread guide tube guided concentrically inside the Laval nozzle essentially is arranged in a plane extending parallel to an imagined plane in which the outlet end rim of the Laval nozzle is located.

A nozzle of this form is apt to feed threads at speeds of up to 6000 m/min into the subsequent stuffer box. The high pressure and the considerable consumption of compressed air necessarily implied by this system are seen as disadvantages of this system.

It thus is the goal of the present invention to create a thread aspiring suction system of a stuffer box crimping nozzle for synthetic threads in such a manner that a thread tension is generated in the suction arrangement which permits higher processing speeds at sufficient tension in the thread for avoiding lap formation on the drawing godets.

According to one aspect of the present invention, a method of stuffer box crimping synthetic filament threads is provided. According to the method, an air stream is supplied into a suction nozzle at supersonic speed. Filament threads are aspired into the suction nozzle using the air stream. The filament threads are transported through the suction nozzle, using the air stream, toward a stuffer box. Two or more air streams are supplied such that the two or more air streams cross one another.

According to another aspect of the present invention, a method of stuffer box crimping synthetic filament threads is provided. According to the method, an air stream is supplied into a suction nozzle at supersonic speed. Filament threads are aspired into the suction nozzle using the air stream. The filament threads are transported through the suction nozzle, using the air stream, toward a stuffer box. The air stream is supplied such that a twist is imparted to the filament threads.

According to yet another aspect of the present invention, a method of stuffer box crimping synthetic filament threads is provided. According to the method, an air stream is supplied into a suction nozzle at supersonic speed. Filament threads are aspired into the suction nozzle using the air stream. The filament threads are transported through the suction nozzle, using the air stream, toward a stuffer box. The air stream is supplied from a ring nozzle arranged about, and concentric with, the filament threads.

According to yet another aspect of the present invention, a method of stuffer box crimping synthetic filament threads is provided. According to the method, at least two air streams are supplied into a suction nozzle. Filament threads are aspired into the suction nozzle using the at least two air streams, the air streams being supplied consecutively in a direction of thread transport. The filament threads are transported, using the air streams, toward a stuffer box.

According to still another aspect of the present invention, an apparatus for stuffer box crimping a synthetic filament thread is provided. The apparatus includes a thread inlet duct for aspiring and guiding synthetic filament threads to a stuffer box. The apparatus includes a flow duct, the thread inlet duct preceding the flow duct, the flow duct and the thread inlet duct having a common longitudinal axis. Two or more sets of nozzles are provided, the sets of nozzles each having at least one nozzle having an outlet opening merging into the flow duct, for supplying a fluid under pressure. The two or more sets of nozzles are arranged consecutively along the longitudinal axis of the thread inlet duct and the flow duck in a direction of thread transport.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
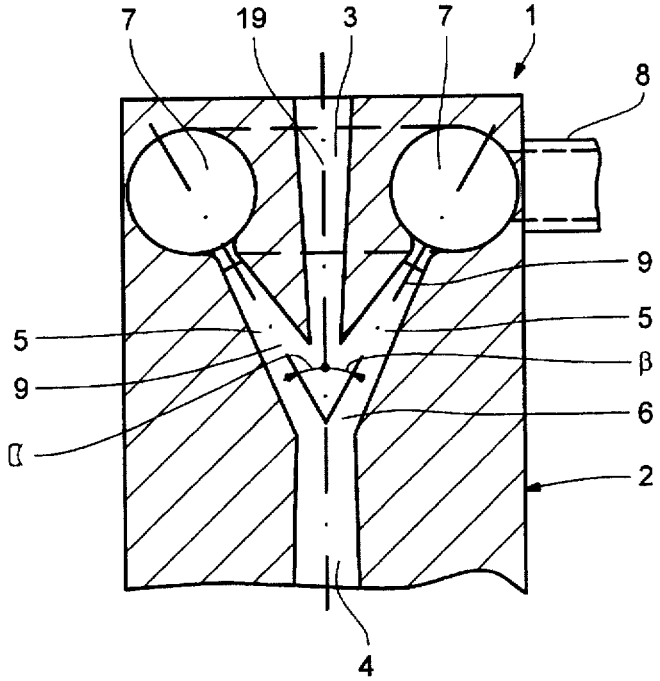
FIG. 1 shows a schematic, cross-sectional view of an aspiring suction element of a stuffer box crimping nozzle according to an embodiment of the present invention.

In FIG. 1 the aspiring suction element 1 is shown which is applied in a stuffer box crimping nozzle such as that nozzle according to EP 039 763. From EP 039 763 it is known that stuffer box crimping nozzles of this type consist of two halves which can be separated for inserting the thread to be crimped. The aspiring suction elements shown in the following FIGS. 1 through 9 are part of a half of a complete stuffer box crimping nozzle. Thus, in FIG. 1, a half nozzle body 2 is provided in which a thread inlet duct 3 merges into a flow duct 4.

Between the thread inlet duct 3 and the flow duct 4 a thread take-over room 6 is provided. Laval nozzles merge into the take-over room 6 on both sides of the take-over room, i.e., the left and the right. The longitudinal axis 9 of the Laval nozzle shown to the left forms an angle $\alpha$ with the longitudinal axis 19 of the thread inlet duct 3, or of the flow duct 4 respectively, and the longitudinal axis 9 of the Laval nozzle shown to the right forms an angle $\beta$ with the aforementioned longitudinal axis 19. In this arrangement the angles $\alpha$ and $\beta$ can be chosen to be equal or different, which choice can determined, e.g., empirically.

In FIG. 1 the Laval nozzles 5 are arranged symmetrically and their longitudinal axes 9 intersect in the longitudinal axis 19, the angles $\alpha$ and $\beta$ being chosen to be identical. In alternative embodiments (not shown), the angles of the longitudinal axes 9 of the Laval nozzles 5 can be chosen to be unequal, the axes of the Laval nozzles and the longitudinal axis 19 may not intersect in the same point, and the Laval nozzles can be arranged mutually offset in such a manner that a torsional momentum is applied to the thread. This means that at least one of the Laval nozzles is not merging centrally into the thread take-over room 6 but essentially tangentially, i.e., near the wall. The alternative embodiments described above apply as well to the Laval nozzles described below.

For supplying the Laval nozzles 5 with a propellant fluid the Laval nozzles 5 are connected to an air supply duct 7 which, in the aspiring suction half-element 1, has a semicircular shape, i.e., both Laval nozzles 5 are connected to the same air supply duct. Furthermore the air supply duct 7 is provided with an air supply tube 8 for supplying the propellant fluid from the outside into the air supply duct 7.

Figure 2:
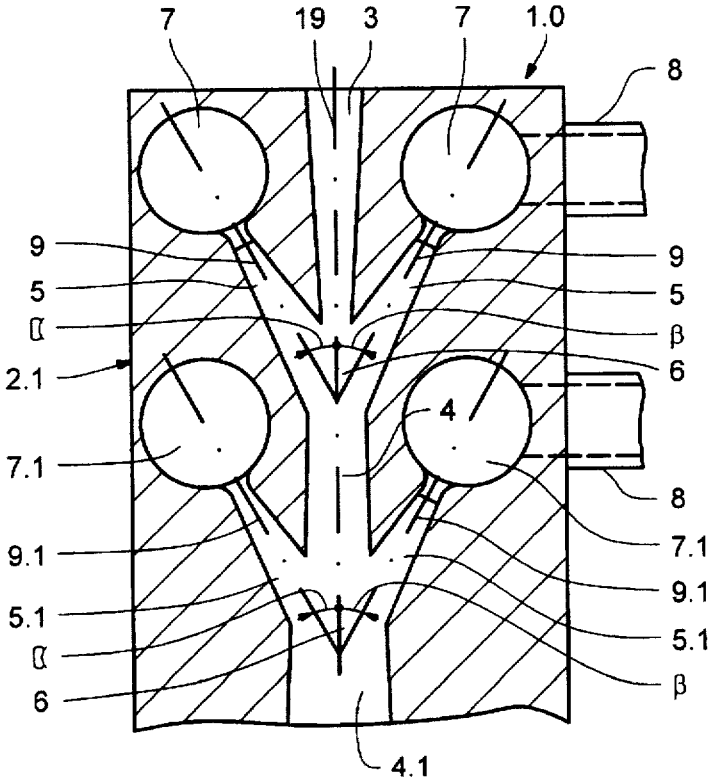
FIG. 2 shows schematic, cross-sectional view of an aspiring suction element of a stuffer box crimping nozzle according to a second embodiment of the present invention.

An aspiring suction element 1*a* shown in FIG. 2 is a so-called "double decker" in so far as the combination of the Laval nozzles 5 including the air supply duct 7, the air supply tube 8 and the thread take-over room 6 are provided twice, arranged superimposed, or in other terms, are provided consecutively, seen in the direction of thread transport. If desired or necessary, suction elements can be provided, seen in the direction of thread transport, in combinations of greater than two suction elements, as well. Corresponding identical elements of the lower, or consecutive, arrangement are identified by the same reference numeral 5 as in the upper arrangement, but are distinguished by the designation ".1". The flow duct 4.1 shown in FIG. 2 is provided with a predetermined cross-section which is larger than the one of the preceding flow duct 4, the additional air quantity being taken into account. In this arrangement the cross-sections of the flow ducts 4 and 4.1, respectively, are determined experimentally in order to avoid generation of a counterflow in the thread inlet duct due to a propellant build-up in the flow duct.

Figure 3:
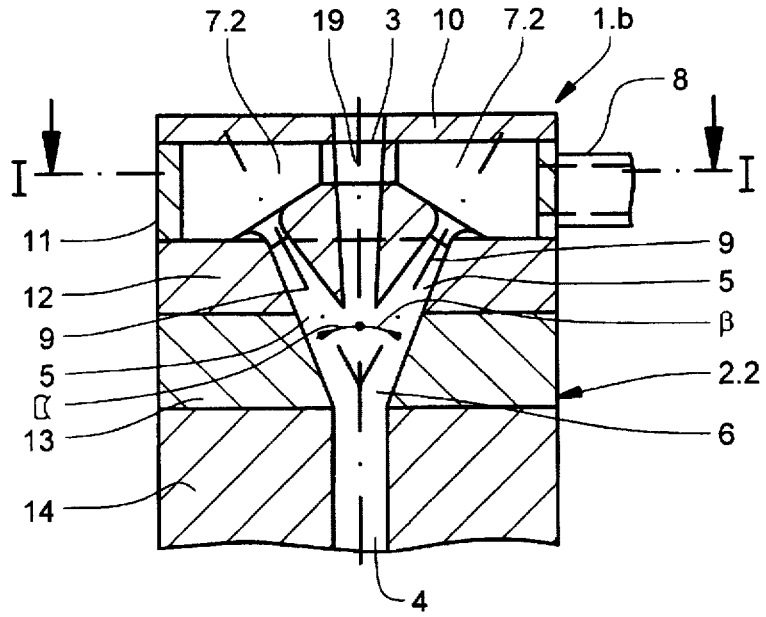
FIG. 3 shows a schematic, cross-sectional view of an aspiring suction element of a stuffer box crimping nozzle according to a third embodiment of the present invention.
Figure 6:
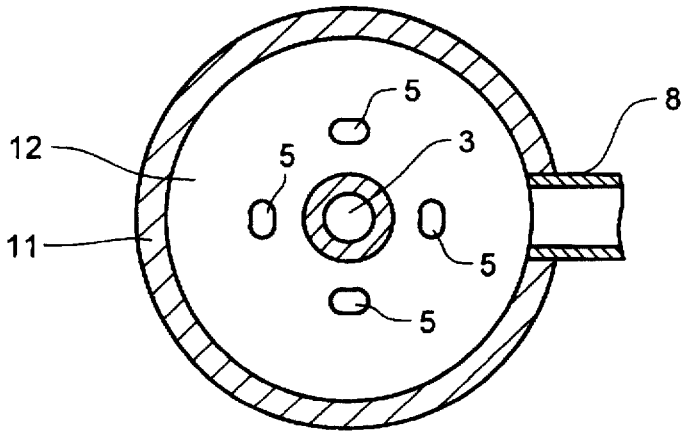
FIG. 6 is a cross-sectional view taken at section 6—6 of FIG. 3.

In FIG. 3 the aspiring suction element 1.*b* differs from the one shown in FIG. 1 in so far as, in FIG. 3, a plurality of Laval nozzles is arranged around the thread inlet duct, as further shown in FIG. 6. In this arrangement, the number of Laval nozzles as well as their distribution can be chosen, i.e., an arrangement of this type is determined based on experiments. The aspiring suction element 1.*b* furthermore comprises, in addition to the Laval nozzles 5, the thread inlet duct 3, the flow duct 4, the thread take-over room 6, and a nozzle body 12 in which the Laval nozzles are arranged.

The nozzle body 12 with its upper face side fits against a ring wall 11 and with its lower face side fits against a ring member 13. The ring wall 11, together with the nozzle body 12 and with a cover 10, forms the air supply duct 7.2. The propellant fluid (hot air or steam as rule) is supplied into the air supply duct 7.2 via the air supply tube 8 inserted into the ring wall 11.

The ring member 13 forms the thread take-over room 6 and the flow duct 4 is provided in a base member 14 which fits against the ring member 13. The elements 10, 11, 12, 13 and 14 each represent half ring members which are joined together to form the nozzle half body 2.2. In this arrangement the means holding the superimposed elements 10, 11, 12, 13 and 14 together are not shown, however, such means can be clamps, screws or other mechanical means, or can be adhesives.

Also in this arrangement the Laval nozzles form the angles $\alpha$ and $\beta$ with the longitudinal axis 19. The further elements functionally corresponding to elements of FIG. 1 are referred to under the same reference numerals, or under the same reference numerals amended by an index.

Figure 4:
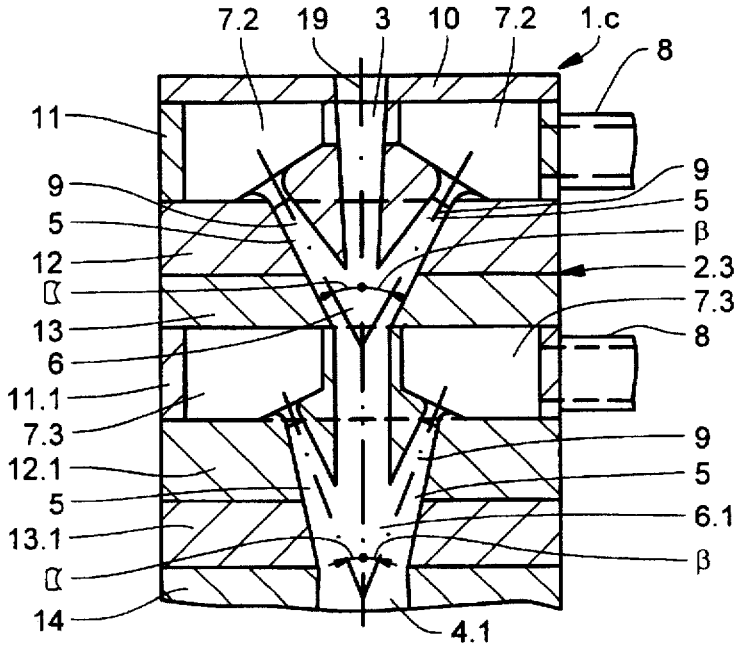
FIG. 4 shows a schematic, cross-sectional view of an aspiring suction element of a stuffer box crimping nozzle according to a fourth embodiment of the present invention.

In FIG. 4 the aspiring suction element 1.*c* shows an alternative embodiment laid out in the same manner as the alternative embodiment shown in FIG. 2 in comparison with the one shown in FIG. 1. In this arrangement the elements of the lower arrangement, as seen in FIG. 4, of Laval nozzles are identified by the same reference numerals as the elements of the upper arrangement of Laval nozzles but are distinguished by the designation ".1". On the other hand the elements functionally corresponding to the elements according to FIG. 1 are referred to under the same reference signs, or under reference signs distinguished by the designation ".3". By analogy to FIG. 2 the flow duct 4.1 is provided with a predetermined cross-section which is larger than the one of the flow duct 4, taking the additional air quantity into account.

Figure 5:
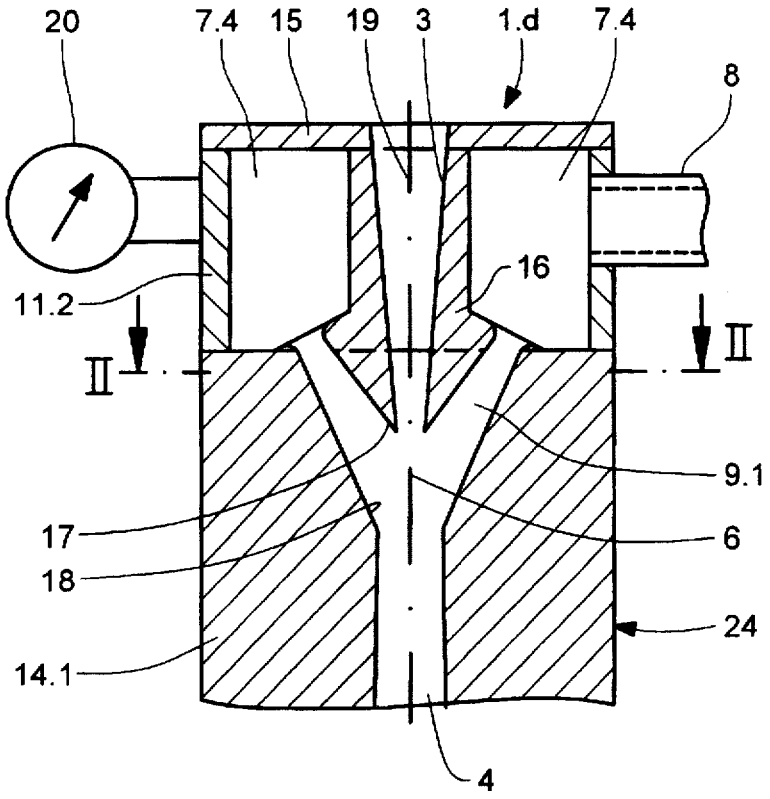
FIG. 5 shows a schematic, cross-sectional view of an aspiring suction element of a stuffer box crimping nozzle according to a fifth embodiment of the present invention.
Figure 7:
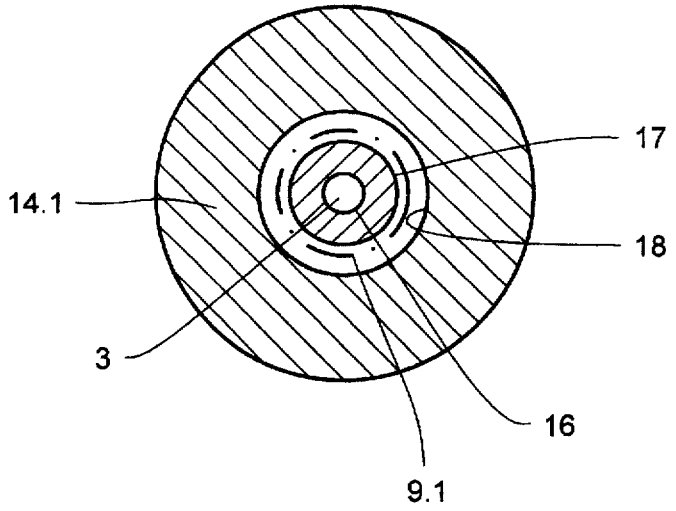
FIG. 7 is a cross-sectional view taken at section 7—7 of FIG. 5.

In FIG. 5 the aspiring suction element 1.*d* represents an alternative embodiment compared to the one shown in FIG. 3 in so far as what will be referred to as "an infinite number" of Laval nozzles are arranged in a circle such that a ring nozzle is formed, as shown in a combination of the FIGS. 5 and 7. In this arrangement, the ring nozzle is formed by an outside cone surface 17 provided on an insert member 16 and by an inside cone surface 18 provided on the base member 14.1. Furthermore the aspiring suction element 1.*d* is composed of the base member 14.1, the ring wall 11.2 adjacent to it, and the cover 15 comprising the insert member 16.

In the insert member 16, the thread inlet duct 3 and in the base member 14.1 the flow duct 4 are provided. The base member 14.1 together with the ring wall 11.2, the cover 15 and the insert member 16 forms, above the aforementioned ring nozzle, a half-ring shaped air supply duct 7.4 to which the air supply tube 8 is connected.

In an alternative embodiment compared to the one shown in FIG. 5 in which the outside cone surface 17 is arranged to be concentric with the inside cone surface 18, a spiral groove may be sunk into the inside cone surface 18 in order to impart a twisting movement to the propellant fluid supplied and thus also to the aspired thread.

The longitudinal axes 9 which, in the FIGS. 1 through 4, represent the longitudinal axes of the Laval nozzles 5, the longitudinal axes 9.1 in FIG. 5 represent the cross-section of the infinite number of Laval nozzles, i.e., the ring nozzle.

A pressure gauge 20 is connected to the ring wall 11.2 to measure the pressure prevailing in the air supply duct 7.4. A pressure gauge may, if desired or necessary, be used with all the aforementioned embodiments of the air supply ducts 7 through 7.3 as well.

Figure 8:
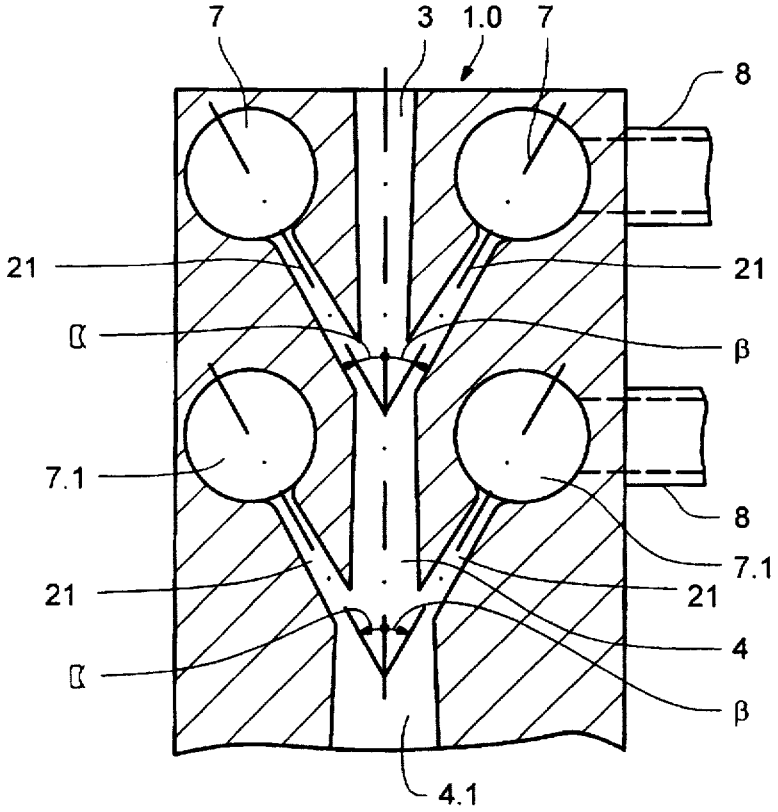
FIG. 8 shows a schematic, cross-sectional view of an aspiring suction element of a stuffer box crimping nozzle according to a sixth embodiment of the present invention.
Figure 9:
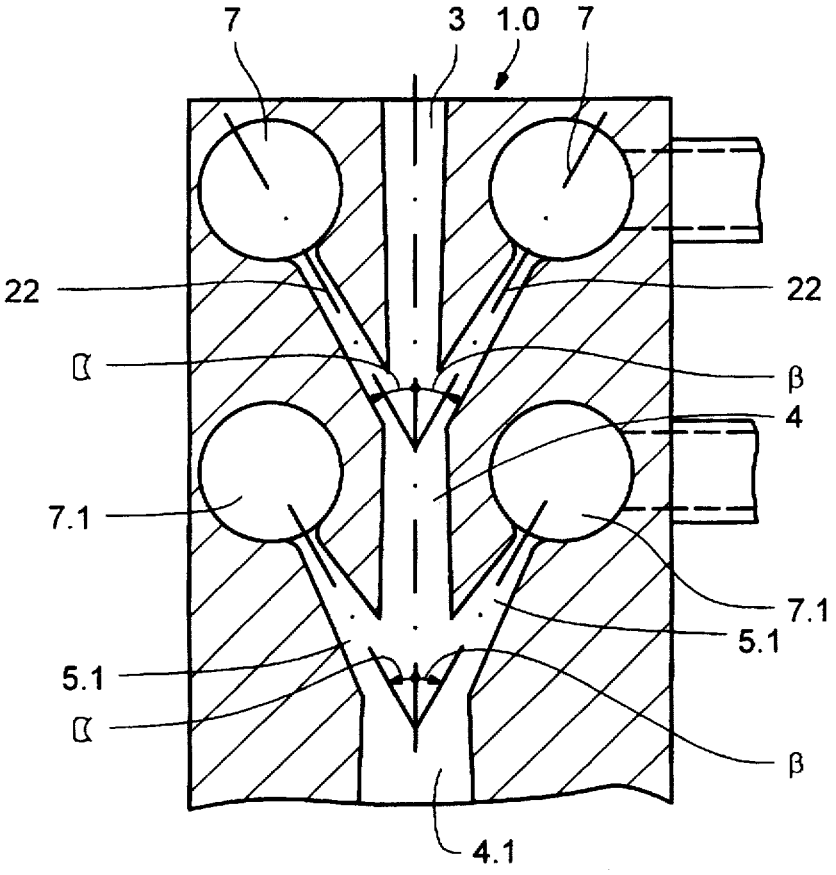
FIG. 9 shows a schematic, cross-sectional view of an aspiring suction element of a stuffer box crimping nozzle according to a seventh embodiment of the present invention.

It is to be noted furthermore that the "double decker", or superimposed nozzles 5 described with reference to FIGS. 2 and 4 also can be used as nozzles which are not supersonic nozzles but, as shown in FIGS. 8 and 9, are cylindrical nozzles 21 (FIG. 8) or narrowing nozzles 22 (FIG. 9). In the arrangements shown in FIGS. 8 and 9, a conical transition from the air supply duct 7, or 7.1 respectively, to the nozzle 21 or 22, can be provided, as shown also in FIGS. 2 and 4. The nozzles 21 or 22 in the arrangements shown in FIGS. 8 or 9 can be laid out as sub-sonic nozzles or as sonic nozzles.

As shown in FIG. 9, it is also possible to use sub-sonic nozzles, sonic nozzles, and supersonic nozzles in the same aspiring suction element 1.0, in which arrangement the combination of nozzles is determined empirically. Referring to FIGS. 8 and 9 it is to be noted also that functionally identical elements are designated with the same reference signs as in the preceding Figures.

Finally it is to be mentioned that for imparting twist to the thread the nozzles 5, 21 and 22 as mentioned with reference to FIGS. 1 and 2 can be arranged in such a manner that the feed of the air supplied into the flow duct 4, 4.1 is off-centered, which imparts a twist to the thread.

While this invention has been illustrated and described in accordance with a preferred embodiment, it is recognized that variations and changes may be made therein without departing from the invention as set forth in the claims.

What is claimed is:

1. A method of stuffer box crimping synthetic filament threads, comprising the steps of:

supplying at least two air streams into a suction nozzle;

aspiring filament threads into the suction nozzle using the at least two air streams, the air streams being supplied consecutively in a direction of thread transport; and transporting the filament threads, using the air streams, toward a stuffer box.

2. A method according to claim 1, wherein at least one air stream is supplied at supersonic speed.

3. A method according to claim 1, wherein at least one air stream is supplied at a sub-sonic speed.

4. A method according to claim 1, wherein at least one air stream is supplied at substantially sonic speed.

5. A method according to claim 1, wherein at least one air stream is supplied at substantially sonic speed and a second, subsequent air stream is supplied at supersonic speed.

6. Method according to claim 1, wherein at least two air streams are supplied such that they cross each other, and the at least two crossing air streams are supplied consecutively in the direction of thread transport.

7. A method according to claim 1, wherein the air streams are supplied such that a twist is imparted to the filament threads.

8. A method according to claim 1, wherein the air streams are supplied from nozzles arranged in ring form about, and concentric with, the filament threads.

9. An apparatus for stuffer box crimping a synthetic filament thread, comprising:

a thread inlet duct for aspiring and guiding synthetic filament threads to a stuffer box;

a flow duct, the thread inlet duct preceding the flow duct, the flow duct and the thread inlet duct having a common longitudinal axis; and a nozzle, the nozzle having an outlet opening merging into the flow duct, for supplying a fluid under pressure to advance the threads, wherein the nozzle is a Laval nozzle with a supersonic zone, the supersonic zone being arranged such that a longitudinal axis of the Laval nozzle and the longitudinal axis of the thread inlet duct and the flow duct form a predetermined acute angle and such that the fluid takes over the threads at supersonic speed.

10. The apparatus according to claim 9, wherein two or more Laval nozzles are arranged consecutively, in a direction of thread transport, along the longitudinal axis of the thread inlet duct and the flow duct.

11. An apparatus for stuffer box crimping a synthetic filament thread, comprising:

a thread inlet duct for aspiring and guiding synthetic filament threads to a stuffer box;

a flow duct, the thread inlet duct preceding the flow duct, the flow duct and the thread inlet duct having a common longitudinal axis; and two or more sets of nozzles, the sets of nozzles each having at least one nozzle having an outlet opening merging into the flow duct, for supplying a fluid under pressure, the two or more sets of nozzles being arranged consecutively along the longitudinal axis of the thread inlet duct and the flow duct in a direction of thread transport.

12. An apparatus according to claim 11, wherein the nozzles of the two or more sets of nozzles each have longitudinal axes, and the nozzles of the two or more sets of nozzles are each arranged such that the longitudinal axes of the nozzles of the two or more sets of nozzles and the longitudinal axis of the thread inlet duct and the flow duct form one or more acute angles.

13. An apparatus according to claim 11, wherein at least one nozzle is arranged such that fluid supplied therefrom imparts a twist to the thread.

14. An apparatus according to claim 11, wherein at least one of the two or more sets of nozzles includes two or more nozzles, the two or more nozzles being arranged symmetrically with respect the longitudinal axis of the thread inlet duct and the flow duct.

15. Apparatus according to claim 14, wherein the two or more nozzles are arranged in a circle around the thread inlet duct.

16. Apparatus according to claim 11, wherein at least one of the nozzles of the two or more sets of nozzles is a ring nozzle, the ring nozzle being concentric around the longitudinal axis of the thread inlet duct and the flow duct.

17. An apparatus according to claim 16, wherein a plane through a center of a passage of the ring nozzle defines a cone.

* * * * *